US009505546B2

(12) United States Patent
Arora et al.

(10) Patent No.: US 9,505,546 B2
(45) **Date of Patent: *Nov. 29, 2016**

(54) SPRAYHEAD FOR A SPRAY DEVICE

(71) Applicant: Conopco, Inc., Englewood Cliffs, NJ (US)

(72) Inventors: Amit Arora, Leeds (GB); Kassie Terra-Lynn Betts, Carlsbad, CA (US); Simon Lewis Bilton, Leamington Spa (GB); Joseph Butler, Rugby (GB); Christopher John Jones, Tewkesbury (GB); Garen Kouyoumjian, Leamington Spa (GB)

(73) Assignee: Conopco, Inc., Englewood Cliffs, NJ (US)

( * ) Notice: Subject to any disclaimer, the term of this patent is extended or adjusted under 35 U.S.C. 154(b) by 89 days.

This patent is subject to a terminal disclaimer.

(21) Appl. No.: 14/366,108

(22) PCT Filed: Dec. 6, 2012

(86) PCT No.: PCT/EP2012/074610

§ 371 (c)(1),
(2) Date: Jun. 17, 2014

(87) PCT Pub. No.: WO2013/092231

PCT Pub. Date: Jun. 27, 2013

(65) Prior Publication Data

US 2014/0329918 A1 Nov. 6, 2014

(30) Foreign Application Priority Data

Dec. 22, 2011 (EP) ..... 11195091

(51) Int. Cl.
*B65D 83/20* (2006.01)
*B65D 83/22* (2006.01)
*B65D 83/14* (2006.01)

(52) U.S. Cl.
CPC ..... *B65D 83/22* (2013.01); *B65D 83/205* (2013.01); *B65D 83/206* (2013.01); *B65D 83/752* (2013.01); *B65D 2215/04* (2013.01)

(58) Field of Classification Search
CPC ..... B65D 2215/04; B65D 83/205; B65D 83/206; B65D 83/22; B65D 83/752
See application file for complete search history.

(56) References Cited

U.S. PATENT DOCUMENTS 3,426,948 A 2/1969 Stirling
3,429,483 A 2/1969 Mlcalleff (Continued)

FOREIGN PATENT DOCUMENTS

CN 101528564 9/2009
CN 101641267 2/2010

(Continued)

OTHER PUBLICATIONS

PCT International Search Report in PCT application PCT/EP2012/074610 dated Mar. 7, 2013 with Written Opinion.

(Continued)

*Primary Examiner* — Frederick C Nicolas
*Assistant Examiner* — Bob Zadeh
(74) *Attorney, Agent, or Firm* — Karen E. Klumas

(57) ABSTRACT

A sprayhead including; a chassis capable of firm attachment to an aerosol container, the chassis including a circular platform and a peripheral skirt; a rotatable circular collar that includes a bridge that spans a diameter of the collar; and a spray channel and associated actuator button, the spray channel being designed to pass through a central aperture in the circular platform of the chassis and through a central aperture in the bridge; the chassis holding the spray channel and associated actuator button in a non-rotatable manner, and the collar being rotatable between a first position in which the spray channel is incapable of depression and a second position in which the spray channel is capable of depression when pressure is applied to the associated actuator button.

11 Claims, 6 Drawing Sheets

(56) References Cited

U.S. PATENT DOCUMENTS

| | | | | |
|---|---|---|---|---|
| 3,777,789 | A | 12/1973 | Corlet | |
| 4,542,837 | A | 9/1985 | Rayner | |
| 5,337,926 | A | 8/1994 | Drobish | |
| 7,017,785 | B2 | 3/2006 | Lasserre | |
| 7,487,891 | B2 | 2/2009 | Yerby | |
| 7,530,476 | B2 * | 5/2009 | Downey | B65D 83/205 222/153.04 |
| 7,588,171 | B2 * | 9/2009 | Reedy | B65D 83/22 222/153.11 |
| 7,661,568 | B2 | 2/2010 | Vanstaan | |
| 7,686,189 | B2 * | 3/2010 | Althoff | A45D 34/04 222/153.11 |
| 7,699,190 | B2 | 4/2010 | Hygema | |
| 7,861,894 | B2 | 1/2011 | Walters | |
| 7,874,465 | B2 | 1/2011 | Bertin | |
| 8,016,159 | B2 | 9/2011 | Ma | |
| 8,127,968 | B2 * | 3/2012 | Yerby | B65D 83/206 222/153.11 |
| 8,550,306 | B2 | 10/2013 | Angus | |
| 9,260,237 | B2 | 2/2016 | Brace | |
| 2007/0039979 | A1 * | 2/2007 | Strand | B65D 83/22 222/402.11 |
| 2008/0173676 | A1 | 7/2008 | Althoff | |
| 2008/0210710 | A1 * | 9/2008 | Marquardt | B65D 83/206 222/153.11 |
| 2009/0050650 | A1 | 2/2009 | Walters | |
| 2010/0206907 | A1 | 8/2010 | Angus | |
| 2011/0132998 | A1 | 6/2011 | Marzio | |
| 2014/0329918 | A1 | 11/2014 | Arora | |
| 2014/0361044 | A1 | 12/2014 | Arora | |
| 2014/0361049 | A1 | 12/2014 | Arora | |

FOREIGN PATENT DOCUMENTS

| | | | |
|---|---|---|---|
| CN | 102248519 | | 4/2014 |
| EP | 0659157 | | 1/1996 |
| EP | 0659157 | B1 | 1/1996 |
| EP | 1040055 | B1 | 7/2002 |
| EP | 2143661 | A2 | 1/2010 |
| EP | 2049415 | B1 | 11/2010 |
| FR | 2705322 | A1 | 11/1994 |
| FR | 2705322 | B1 | 7/1995 |
| JP | 9040043 | | 2/1997 |
| JP | 2004123136 | | 4/2004 |
| JP | 2004123316 | | 4/2004 |
| WO | WO2004078635 | A2 | 9/2004 |
| WO | WO2007120570 | A2 | 10/2007 |

OTHER PUBLICATIONS

European Search Report in EP application EP 11 19 5091 dated May 31, 2012 with Written Opinion.

PCT International Search Report in PCT application PCT/EP2012/074609 dated Mar. 18, 2013 with Written Opinion.

European Search Report in EP application EP 12 16 4862 dated Mar. 8, 2013 with Written Opinion.

Copending Application: Applicant: Arora et al., Filed: Jun. 17, 2014.

PCT International Search Report in PCT application PCT/EP2012/074608 dated Mar. 22, 2013 with Written Opinion.

European Search Report in EP application EP 12 17 2049 dated Mar. 12, 2013 with Written Opinion.

Co-pending Application: Applicant: Arora et al., Filed: Jun. 17, 2014.

* cited by examiner

SPRAYHEAD FOR A SPRAY DEVICE

TECHNICAL FIELD

The present invention is concerned with an actuator cap or sprayhead for a fluid container that allows the contents of the container to be sprayed without the cap having to be removed. The invention is of particular use in the field of home and personal care when it may be used as part of a hand held aerosol dispenser. A particular aspect of the invention is that the sprayhead enables the dispenser with which it is associated to be interchangeably converted between operative and inoperative states.

BACKGROUND OF THE DISCLOSURE

Sprays through actuator caps enabling conversion between operative and inoperative states, optionally for use with pressurised fluid containers, have been described in the prior art.

WO 2004078635 (Seaquist) discloses an actuator for an aerosol valve comprising an actuator button rotatable between a locked position and unlocked positions.

EP 1,040,055 B1 (Unilever) discloses a sprayhead comprising an over-cap rotatable between a first position in which actuation is possible and a second position in which actuation is not possible.

U.S. Pat. No. 4,542,837 (Metal Box) discloses an actuator having upper and lower rotatable parts which may be rotated between operative and inoperative positions.

EP 2,049,415 B1 (Valois) discloses a fluid dispensing head comprising actuator means for driving a pushbutton in axial displacement relative to the valve rod, the pushbutton being used to trigger dispensing.

WO 07/120570 (Precision Valve) discloses a locking aerosol dispenser with a dome attached to a base lock member and also attached to an aerosol valve mounting cup of an aerosol can.

It as an object of the present invention to provide a robust, yet ergonomically attractive dispensing means for spraying fluid products, particularly products intended for application to the surface of the human body.

The invention is particularly suitable for applying cosmetic products to the surface of the human body, especially to the underarm regions of the human body.

SUMMARY OF THE DISCLOSURE

In a first aspect of the present invention, there is provided: a sprayhead suitable for use with an aerosol container comprising a central valve stem, said sprayhead comprising:

1. a chassis capable of firm attachment to the valve cup of an aerosol container, said chassis comprising a circular platform and a peripheral skirt;
2. a rotatable circular collar located around and largely over the peripheral skirt of the chassis, said collar comprising a bridge spanning a diameter of the collar;
3. a spray channel and associated actuator button, said spray channel being designed to pass through a central aperture in the circular platform of the chassis and through a central aperture in the bridge spanning a diameter of the collar, and being connectable to the central valve stem of an aerosol container with which the sprayhead is designed to be used; and
4. an upper body designed to fit over the chassis and spray channel, the upper body defining a first aperture, optionally covered by a flexible membrane, located over the actuator button associated with the spray channel and a second aperture surrounding the end of the spray channel such as to allow passage of a product from an outlet at the end of spray channel to the exterior;

the chassis holding the spray channel and associated actuator button in a non-rotatable manner and the collar being rotatable between a first position in which the spray channel is incapable of depression and a second position in which the spray channel is capable of depression when pressure is applied to the associated actuator button.

In a second aspect of the present invention, there is provided a method for applying a cosmetic composition to the surface of the human body comprising the use of a sprayhead according to the first aspect of the invention.

The sprayhead of the present invention is designed for use with a supply of fluid product, particularly fluid cosmetic composition for use on the surface of the human body. The fluid product is supplied from a container to which the sprayhead is attached.

The sprayhead is particularly suitable for use with a pressurised aerosol canister containing the product to be dispensed.

A key feature of the invention is that the sprayhead may be easily interchanged between a first position in which it is inoperable and a second position in which it is operable; that is to say, between a first position in which the spray channel may not be depressed and a second position in which the spray channel may be depressed. This change is brought about not by means of a component that the operator uses to actuate the sprayhead, but by means of a rotatable collar that the operator manually turns to interchange the device between inoperable and operable states.

A further benefit of the present invention is that the spray channel, typically the most fragile element of spray through caps, is always robustly held and enclosed by the chassis and upper body respectively. In addition, the spray channel does not need to move in preparation for actuation.

The spray channel, which is connectable to a central valve stem of an aerosol container with which the sprayhead is designed to be used, passes through both a central aperture in the circular platform of the chassis and a central aperture in the bridge spanning a diameter of the collar. This double central holding of spray channel avoids any "in use" lateral pressure upon the valve of the aerosol container with which the sprayhead is designed to be used. Most importantly, this mechanical interaction between the three essential components of the sprayhead and the valve stem of the associated aerosol container gives great "in use" robustness and strength.

Herein, orientation terms such "top" and "bottom", "upper" and "lower" should be understood to refer to the sprayhead in the position it would occupy in normal use sat on the top of a vertically orientated aerosol can with which it is designed to be used, as illustrated in FIG. 1, for example.

When the outlet of the spray channel has a radially disposed outlet, the "front" of the sprayhead should be understood to be in the same radial direction as said outlet. By analogy, the "rear" of the sprayhead should be understood to be the opposite radial direction. "Sides" of the sprayhead should be understood to be "faces" radially orthogonal to the front-to-rear axis.

Herein, the term "central" is used with reference to a plane orthogonal to the top-to-bottom "long" axis of a vertically orientated aerosol can with which the sprayhead is designed to be used. It should also be understood to refer to this plane of the sprayhead as whole, rather than any particular component thereof.

Herein, the term "principle axis" should be understood to be the top-to-bottom "long" axis of a vertically orientated aerosol can with which the sprayhead is designed to be used and the top-to-bottom axis of the sprayhead itself.

Herein, the term "largely" should be understood to mean predominately.

The bridge spanning a diameter of the collar does not need to be a single element and nor does it need to link directly to the extreme radial edges of the collar. In preferred embodiments, the bridge spans the collar at the upper end thereof. It is further preferred that the bridge abuts a section protruding from the top of the circular platform of the chassis, said protruding section limiting the rotational movement of the collar because of its interaction with bridge thereof. Nevertheless, it is essential that the collar retains ability to rotate between a first position in which the sprayhead is inoperable and the bridge preferably abuts a first edge of a section protruding from the top of the circular platform of the chassis and a second position in which the sprayhead is operable and the bridge preferably abuts a second edge of a section protruding from the top of the circular platform of the chassis.

In preferred embodiments, the sprayhead comprises a fourth essential component: an upper body designed to fit over the chassis and spray channel, the upper body defining a first aperture, optionally covered by a flexible membrane, located over the actuator button associated with the spray channel and a second aperture surrounding an outlet from the spray channel such as to allow passage of a product from the spray channel to the exterior.

In preferred embodiments, the spray channel comprises an upright central segment, connectable at its lower end to a valve stem of an associated aerosol can and connecting at its upper end to a segment projecting radially outward from the central segment. In such embodiments, the central segment is in fluid connection with the segment projecting radially outward therefrom and also with the valve stem, when connected thereto. The segment of the spray channel projecting radially outwards does not need to be in the plane orthogonal to the principle axis of the sprayhead, but it does need to have a component of its projection in said plane.

The components of the sprayhead are typically made from plastic. The chassis may be made from polypropylene, as may the spray channel and the upper body, when present. When the upper body has a flexible membrane covering a first aperture located over the actuator button associated with the spray channel, this is typically made from a thermoplastic elastomer.

The features described with reference to the following specific embodiment may be considered preferred features of the generic description given above and/or may be incorporated independently into the subject matter as described the following claims.

DETAILED DESCRIPTION OF THE DISCLOSURE

Figure 1:
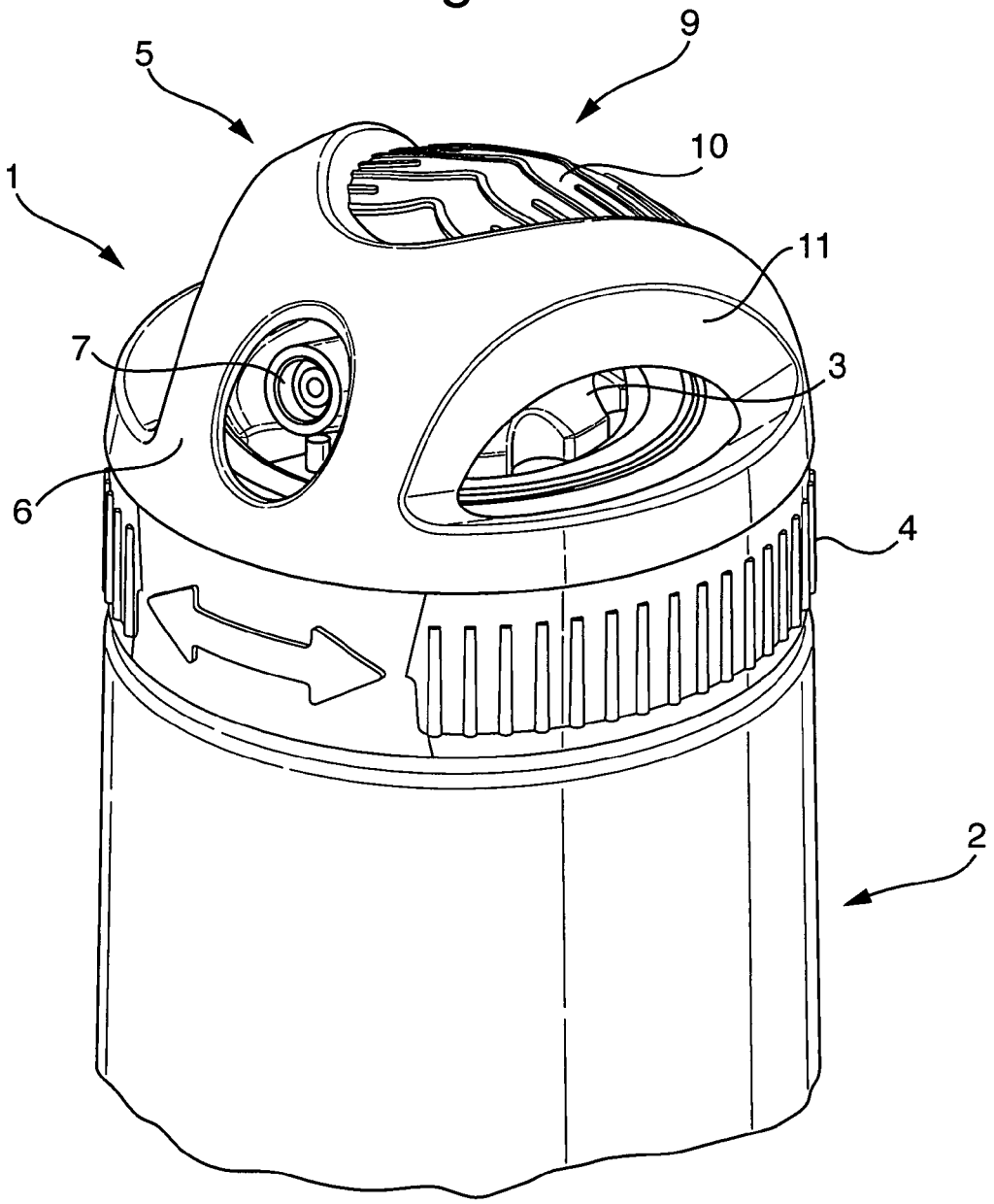
FIG. 1 is an angled view of the sprayhead (1) from top, together with a part view of an associated aerosol can (2).

FIG. 1 illustrates the sprayhead (1) sat on the top of a vertically orientated aerosol can (2) (shown in part) with which it is designed to be used. Features of the sprayhead (1) which can be seen in part are a chassis (3), a rotatable circular collar (4), and an upper body (5) defining a front aperture (6) through which an outlet (7) at the end of spray channel (8) may be seen. The upper body (5) also defines an upper aperture (9) covered by a flexible membrane (10) and two side apertures (11), one of which may be seen in FIG. 1, which reveal the chassis (3) underneath.

Figure 2:
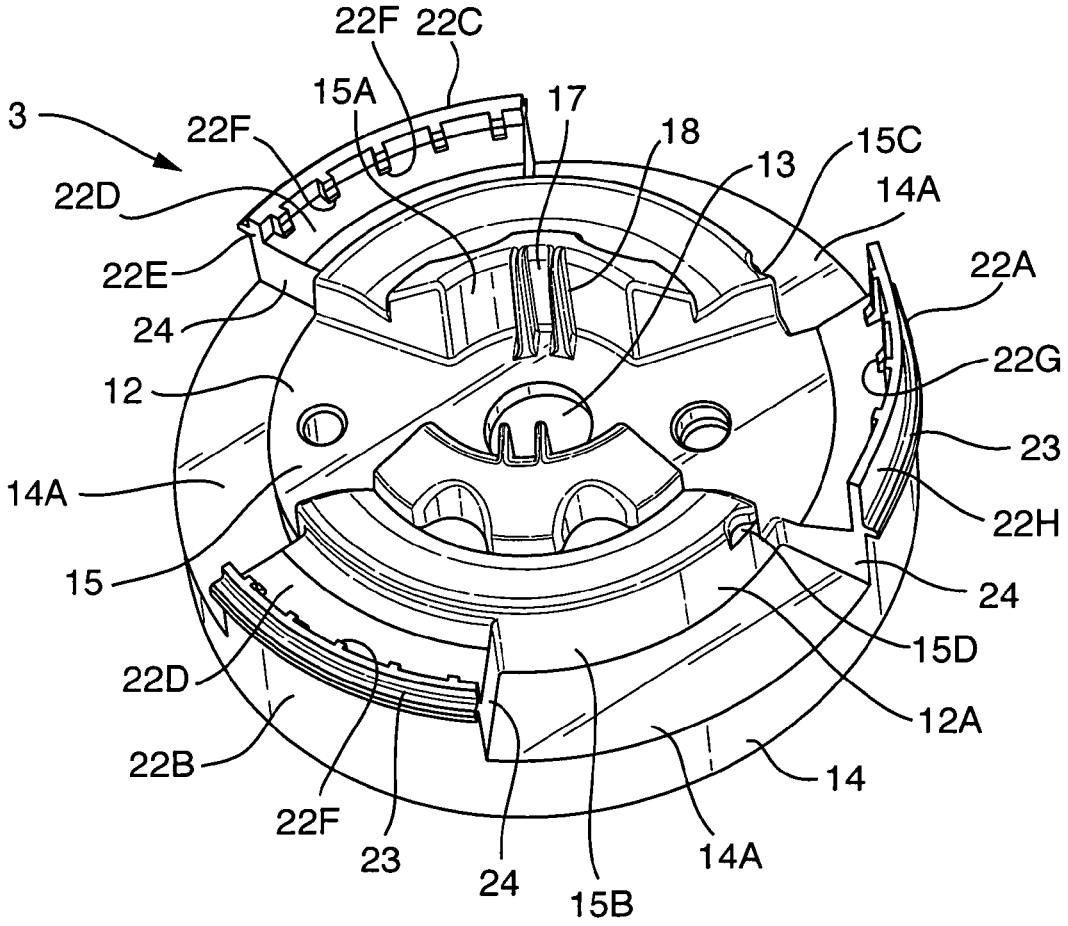
FIGS. 2 and 3 are angled views of a chassis (3) of the sprayhead (1) from above and below, respectively.
Figure 3:
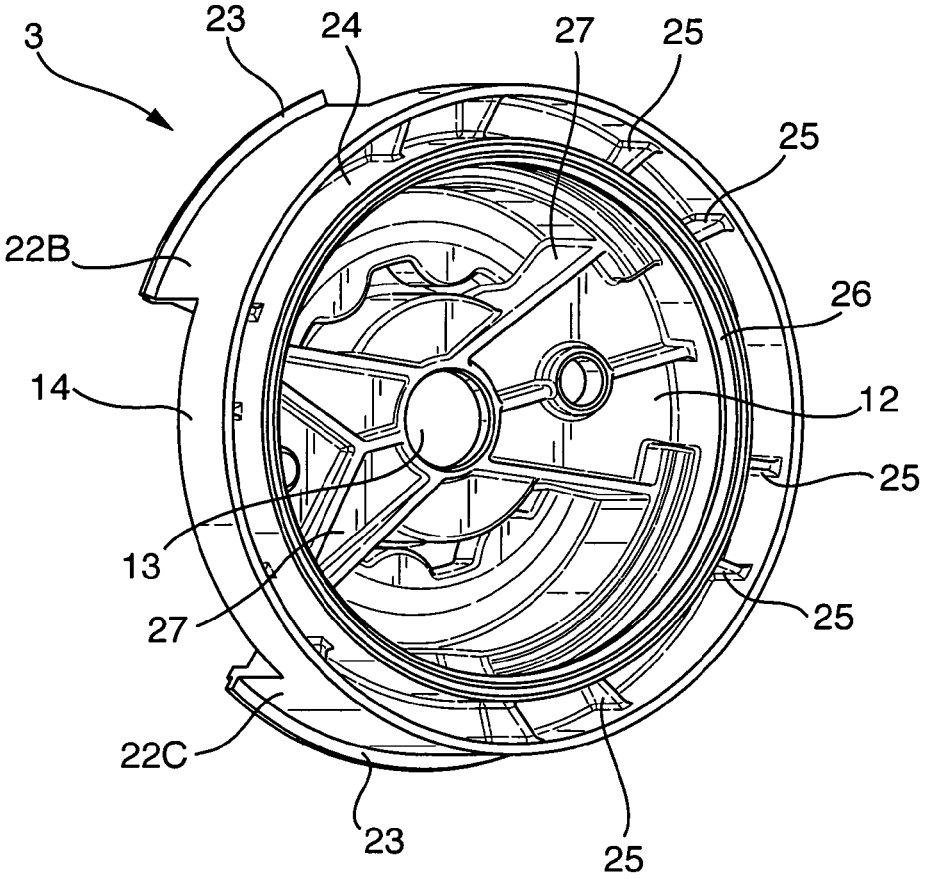

FIGS. 2 and 3 illustrate the chassis (3) in further detail. It may be seen that the chassis (3) has a circular platform (12) extending across its central region punctuated by a central aperture (13) and that there is a circular wall (12A) depending from its edge. The chassis (3) also has a peripheral skirt (14) around its circumference. The upper edge of the peripheral skirt (14) is separated from the lower edge of the circular wall (12A) depending from the circular platform (12) by an annular platform (14A).

Protruding upwards from the circular platform (12) are two sections (15) which are diagonally opposed on either side of the central aperture (13). Between these two protruding sections (15), a bridge (16) of the rotatable collar (4) sits on the upper surface of the when the sprayhead is fully assembled (vide infra). The inner surface (15A) of each of these protruding sections (15) has the shape of the internal surface of a tube having its central axis as the principle axis of the sprayhead (1) and each having the same radius of curvature. Each inner surface (15A) bears a guide slot (17) between each of two internal projections (18) from said inner surface (15A). The guide slots (17) are diagonally opposed on either side of the central aperture (13) and are designed to accommodate wing elements (19) projecting from a central upright segment (20) of a spray channel (8) (vide infra). The interaction between the guide slots (17) in the chassis (3) and wing elements (19) of the spray channel (8) serves to restrict rotational movement of the spray channel (8) relative to the chassis (3).

The outer surface (15B) of each of the protruding sections (15) is an extension of the circular wall (12A) at the edge of the circular platform (12).

FIG. 2 also illustrates three arcuate peripheral projections (22A, 22B, and 22C) equally spaced circumferentially around the upper edge of the peripheral skirt (15). One of these projections (22A) is located towards the rear of the collar (4) and does not radially overlap with the protruding sections (15). The other two projections (22B and 22C) are radially disposed at 120° from the first (22A) and do radially overlap with the protruding sections (15).

Each of these projections (22A, 22B, and 22C) has a bead (23) on its outer surface close to its upper end designed to interact with the rotatable collar (4) and restrict axial movement between the chassis (3), the rotatable collar (4) and the upper body (42) (vide infra).

The peripheral projections (22A, 22B, and 22C) are connected to the circular platform (12) by link walls (24) running from their radial ends to the circular wall (12A) depending from the circular platform (12). For the two peripheral projections (22B and 22C) that radially overlap the protruding sections (15), the link walls (24) also link to the outer surface (15B) of the protruding section (15). These two peripheral projections (22B and 22C) each have an arcuate platform (22D) running part way from their inner surface towards the outer surface (15B) of the protruding section (15). These arcuate platforms (22D) form the top surface of each peripheral projection (22B or 22C) of which they are a part, other than a short wall (22E) extending upwards at the outer edge of the peripheral projections (22B and 22C). The short walls (22E) each bear one of the aforementioned beads (23) on their outer surface and each have struts (22F) on their inner surfaces. Similar, but longer struts (22G) exist on the inner surface on a wall (22H) extending upwards at the outer edge of the peripheral projection (22A) that does not radially overlap the protruding sections (15).

FIG. 3 shows that the chassis (3) has an internal skirt (24) located somewhat inside peripheral skirt (15) and linked thereto by numerous support bridges (25) (some labelled).

The internal skirt (24) has an annular valve cup securing bead (26) around its inner surface close to its lower end designed to hold the chassis firmly and non-rotatably to the valve cup of an aerosol can with which the sprayhead (1) is designed to be used.

FIG. 3 also illustrates that the lower surface of the circular platform (12) of the chassis (3) possesses several strengthening struts (27) (some labelled) that serve to augment the robustness of the sprayhead (1).

Figure 4:
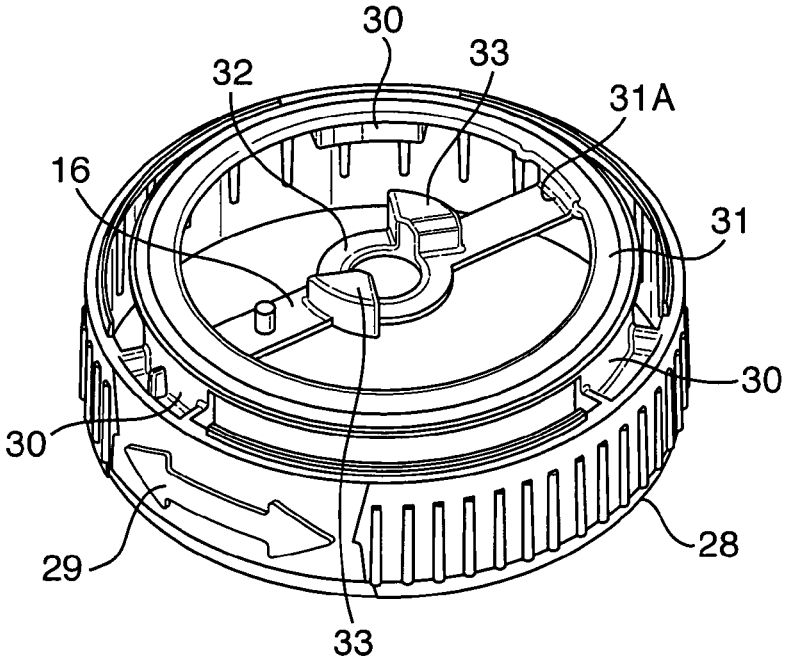
FIGS. 4 and 5 are angled views of a rotatable circular collar (4) of the sprayhead (1) from above and below, respectively.
Figure 5:
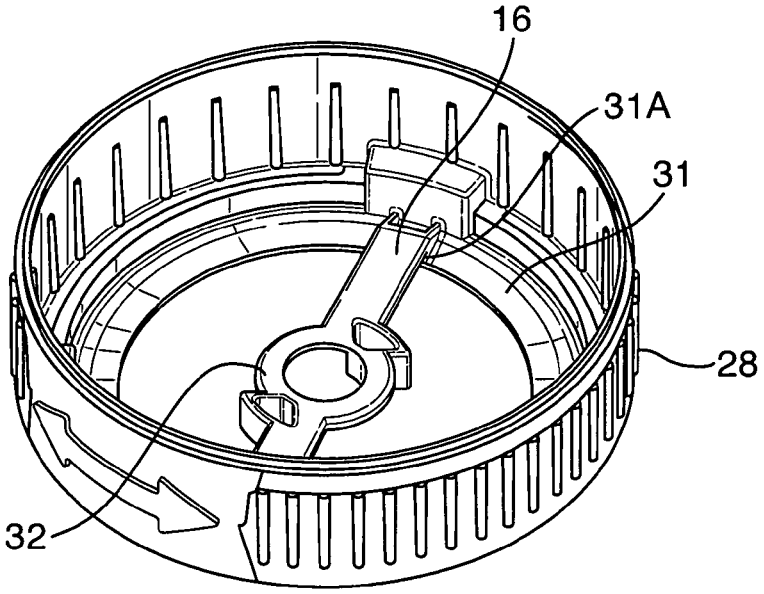

FIGS. 4 and 5 illustrate features of the rotatable circular collar (4) in further detail. The collar (4) has a knurled outer wall (28) bearing a left-right doubled headed arrow graphic (29) to indicate to the user that the collar (4) is rotatable. Linked to the outer wall (28) at its top end by three bridge elements (30), radially equally spaced around collar (4), is a circular disc (31). The circular disc (31) is held somewhat above the top of the outer wall (28) by the bridge elements (30) and is designed to sit on the arcuate platforms (22D) of the peripheral projections (22B and 22C) that radially overlap with the protruding sections (15) of the chassis (3). The inner edge of the circular disc (31) abuts the outer surface (15B) of each of the protruding sections (15) and the outer edge is within the walls (22E and 22H) extending upwards at the outer edge of the peripheral projections (22A, 22B, and 22C).

Suspended from the circular disc (31) by diagonally opposed linkages (32) there is a bridge (16), spanning a diameter of the circular disc (31). The linkages (32) hold the main body of the bridge (16) at a height approximately level with the top of the outer wall (28).

The bridge (16) comprises an annular ring (32) at its centre, through which a central upright segment (20) of a spray channel (8) is designed to fit (vide infra). The bridge (16) is designed to sit on the circular platform (12) of the chassis (3) and to be rotatable thereon between the confines imposed by the sections (15) protruding from the circular platform (12). Protruding from the upper surface of the bridge (16) and bordering the annular ring (32) thereof are two truncated wedge elements (33).

Figure 6:
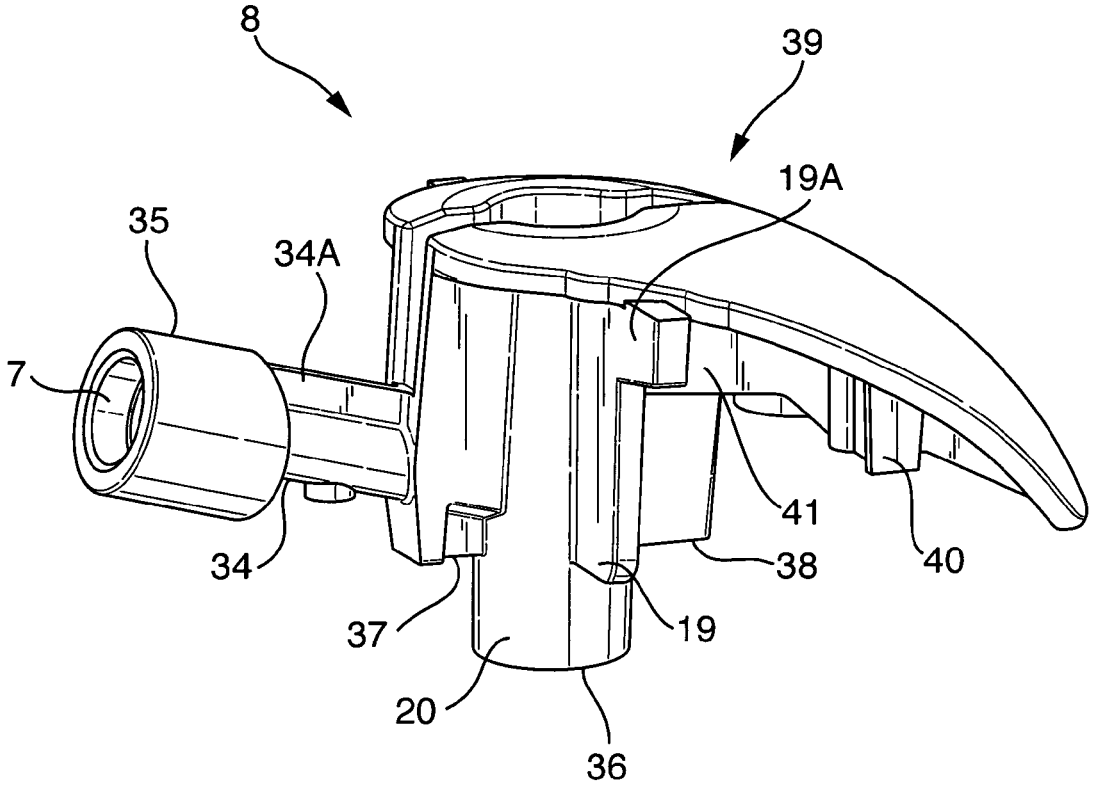
FIG. 6 is a view of a spray channel (8) and associated elements of the sprayhead (1).

The spray channel (8) illustrated in FIG. 6 comprises a central upright segment (20) and a radial segment (34) that slopes upwards as it radiates outwards. The radial segment (34) is terminated by an expanded section (35), which may accommodate a swirl chamber (not shown) and which has the outlet (7) of the spray channel (8) at its terminus. The radial segment (34) has a strengthening strut (34A) protruding upwards from its outer surface.

The radial segment (34) is in fluid communication with the central upright segment (20) which is itself in fluid communication with a valve stem of an associated aerosol can (2) (not shown) via a valve stem socket (36) when the sprayhead (1) is in use.

The central upright segment (20) has wing elements (19) projecting radially outwards from its sidewall in opposite directions orthogonal to the radial direction of the radial segment (34) of the spray channel (8). These wing elements (19) are designed to fit within the guide slots (17) on either side of the central aperture (13) of the chassis (3). (vide supra). The wing elements (19) do extend outwards from the lower region of the central upright segment (20).

The central upright segment (20) also has fore and aft projections (37 and 38, respectively) from its sidewall. The fore projection (37) has the same radial direction as the radial segment (34) of the spray channel (8) and the aft projection (38) projects outwards in the opposite radial direction. The fore projection (37) has a T-shaped cross-section at its lower end. The fore and aft projections (37 and 38, respectively) do extend outwards from the lower region of the central upright segment (20), both terminating at same axial height at which the wing elements (19) orthogonal to them terminate.

At there upper ends, the wing elements (19) project out distinctly further, to give what might be called upper wind extensions (19A).

Associated with the spray channel (8) at its top end is an actuator button (39) which curves downwards towards the rear and has a vaulted shape when viewed from above. On the underside of the actuator button (39) there are several strengthening struts, only two of which (40 and 41) are illustrated.

Figure 7:
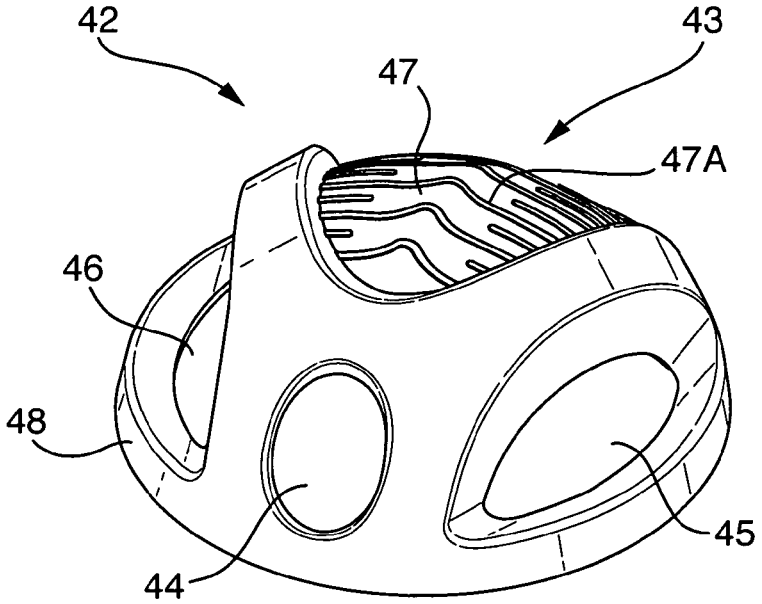
FIGS. 7 and 8 are views of an upper body (42) of the sprayhead (1) from above and below respectively.
Figure 8:
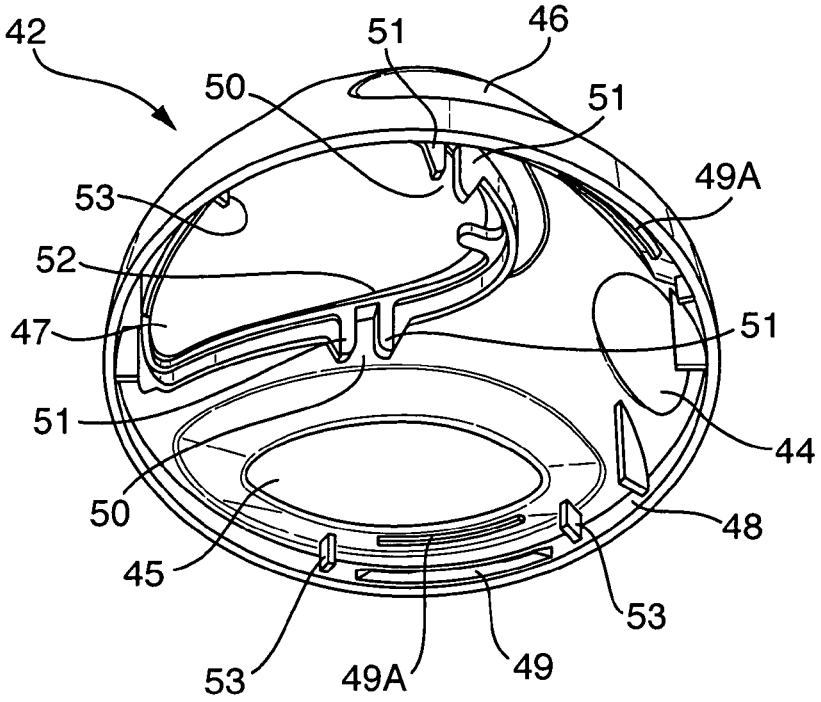

Sat over all the other components of the sprayhead (1), there is an upper body (42) as illustrated in FIGS. 7 and 8. The upper body (42) defines a first aperture (43) located over the actuator button (39) associated with the spray channel (8) and a second aperture 44) surrounding the outlet (7) from the spray channel (8). The upper body (42) also defines two side apertures (45 and 46) which afford the consumer a view of internal features of the sprayhead (1).

The first aperture (43) is covered by a flexible membrane (47) which has ridges (47A) on its upper surface and is typically made of a thermoplastic elastomer.

The upper body (42) has a peripheral skirt (48) of circular cross-section. This skirt (48) overlaps the three arcuate peripheral projections (22A, 22B, and 22C) which upwardly extend the peripheral skirt (15) of the chassis (3). The peripheral skirt (48) of the upper body (42) has three inward projecting ridges (49) equally spaced around its lower inner edge. One of these ridges (49) is illustrated in FIG. 8. These three ridges (49) are designed to clip under the beads (23) on the outer surface of each of the peripheral projections (22A, 22B, and 22C) from the chassis (3) and thereby hold the upper body (42) and chassis (3) axially together.

The lower edges of the inward projecting ridges (49) sit on the upper edge of the knurled outer wall (28) of the collar (4), but do not restrict rotation thereof.

FIG. 8 illustrates two of three ridges (49A) that project downward from the bottom of the inner surface of the upper body (42). These downward projecting ridges (49A) are radially aligned with the inward projecting ridges (49) from the peripheral skirt (48) of the upper body (42) and are designed to interact with the struts (22F and 22G) on the inner surfaces of the walls (22E and 22H) at the edges of and the arcuate platforms (22). of the chassis (3) and thereby enhance the robustness of the connection between the upper body (42) and the chassis (3).

Other features of the upper body (42) that can be seen in FIG. 8 are two downward projecting slots (50) between projections (51) from the edge of the first aperture (43) in the upper body (42), i.e., the aperture located over the actuator button (39). These slots (50) are designed to accommodate the upper wing extensions (19A) of the wing extensions (19) from the sidewall of the central upright segment (20) of the spray channel (8). This interaction between the upper body (42) and spray channel (8) aids the good rotational alignment between the two.

Another feature that aids the good rotational alignment between the upper body (42) and spray channel (8) is a downward projecting peripheral wall (52) around the edge of the first aperture (43) in the upper body (42) and the fact that the actuator button (39) has the same shape as said first aperture (43).

The underside of upper body (42) also comprising three sets of two struts (53), some of which are illustrated in FIG. 8. These project inwards from the peripheral skirt (48) and are positioned to interact with the link walls (24) that form the radial edges of the peripheral projections (22A, 22B, and 22C) from the chassis (3) and thereby prevent rotation of the upper body (42) relative to the chassis 93).

Actuation of the sprayhead (1) and release of the contents of its associated aerosol can (2) is achieved by depression of the spray channel (8) by application of pressure on the associated actuator button (39). This can only be accomplished when the collar (3) is rotated such that the truncated wedge elements (33) protruding from the upper surface of the bridge (16) are not abutting the underside of the fore and aft projections (37 and 38, respectively) from the sidewall of the central upright segment (20) of the spray channel (8). In this position, the central upright segment (20) of the spray channel (8) is able to be pressed down through the central aperture (13) in the chassis (3) and through the annular ring (32) in the centre of the bridge (16) spanning the collar (4), to apply pressure on the valve stem of an associated aerosol can and thereby release the contents thereof through the spray channel (8).

Depression of the spray channel (8), when the collar is rotated as described in the paragraph immediately above, is limited by the bottoms of the fore and aft projections (37 and 38, respectively) and by the bottoms of the wing elements (19) all abutting the top surface of the annular ring (32) in the centre bridge (13) spanning the collar (4). This feature further protects the valve stem of the associated aerosol can. The fore and aft projections (37 and 38, respectively) and the wing elements (19) all extend to the same depth down the central upright segment (20) of the spray channel (8) to assist this.

When pressure is removed from the actuator button (39), a spring in the valve stem of the associated aerosol can forces the spray channel (8) to rise to its original position and the collar (3) may be rotated back to the position in which depression of the spray channel is prevented by the protrusions (33) from the upper surface of the bridge (16) abutting the underside of the fore and aft projections (37 and 38, respectively) from the central upright segment (20) of the spray channel (8).

The invention claimed is:

1. A sprayhead comprising:

a chassis capable of firm attachment to an aerosol container with which the sprayhead is designed to be used, said chassis comprising a circular platform and a peripheral skirt;

a rotatable circular collar located around and largely over the peripheral skirt of the chassis, said collar comprising a bridge spanning a diameter of the collar;

a spray channel and an actuator button associated with the spray channel, said spray channel being designed to pass through a central aperture in the circular platform of the chassis and through a central aperture in the bridge spanning a diameter of the collar, and being connectable to the aerosol container; and an upper body designed to fit over the chassis and the spray channel, the upper body defining a first aperture located over the actuator button and a second aperture surrounding the end of the spray channel to allow passage of a product from an outlet at the end of spray channel;

the chassis holding the spray channel and the actuator button in a non-rotatable manner and the collar being rotatable between a first position in which the spray channel is incapable of depression and a second position in which the spray channel is capable of depression when pressure is applied to the actuator button.

2. The sprayhead according to claim 1, wherein the first aperture, located over the actuator button associated with the spray channel, is covered by a flexible membrane.

3. The sprayhead according to claim 1, wherein the bridge has a protrusion from a circular element defining the central aperture in the bridge which interacts with a lateral projection from a central element of the spray channel to prevent depression of the spray channel when the collar is in the first position.

4. The sprayhead according to claim 3, wherein the bridge has multiple protrusions from the circular element defining the central aperture in the bridge which interact with multiple lateral projections from the spray channel to prevent depression of the spray channel when the collar is in the first position.

5. The sprayhead according to claim 4, wherein the multiple lateral projections are equally spaced around the circular element defining the central aperture in the bridge and the central element of the spray channel, respectively.

6. The sprayhead according to claim 1, wherein the chassis comprises a guide slot into which a wing element from a central element of the spray channel fits in order to restrict rotational movement of the spray channel relative to the chassis.

7. The sprayhead according to claim 1, wherein the chassis restricts rotational movement of the collar.

8. The sprayhead according to claim 7, wherein the chassis comprises a section protruding from the top of a circular platform thereof, said section limiting rotational movement of the collar by interaction with the bridge spanning said collar.

9. The sprayhead according to claim 1, wherein the spray channel comprises an upright central segment.

10. A method of applying a cosmetic composition comprising using the sprayhead according to claim 1 to apply a cosmetic composition to a surface of the human body.

11. An aerosol product comprising the sprayhead according to claim 1 and a cosmetic composition for application to a surface of the human body.

* * * * *